US005247776A

United States Patent [19]

Tamayo

[11] Patent Number: 5,247,776

[45] Date of Patent: Sep. 28, 1993

[54] METHOD FOR OFFSHORE RIG UP PLATFORM PORTABLE MAST

[75] Inventor: Hector A. Tamayo, Houston, Tex.

[73] Assignee: Halliburton Logging Services Inc., Houston, Tex.

[21] Appl. No.: 924,683

[22] Filed: Aug. 3, 1992

[51] Int. Cl.[5] ..... E04G 21/00

[52] U.S. Cl. ..... 52/745.17; 52/111

[58] Field of Search ..... 52/111, 117, 119, 241; 175/57, 745.17, 745.18

[56] References Cited

U.S. PATENT DOCUMENTS 4,231,200 11/1980 Hederson ..... 52/111

4,470,739 9/1984 Brewer et al. ..... 52/117 X

*Primary Examiner*—Carl D. Friedman

*Assistant Examiner*—Creighton Smith

*Attorney, Agent, or Firm*—William J. Beard

[57] ABSTRACT

The present disclosure sets forth a portable workover rig which is formed of a base which can be adjusted through two degrees of freedom to position a rectangular framework leveled with respect to gravity to thereby support derrick sections. The base supports the derrick sections within a derrick support mechanism which is an upstanding axially hollow structure having a side door. Each section of the derrick is inserted into the side door and can be selectively raised by a hydraulic mechanism. Each derrick section is raised to receive another derrick section to extend the derrick from the bottom up to avoid climbing. A crown assembly is placed on the derrick to adjustably position appropriate sheaves for engaging load lines extending from the well head area up to the crown and back to the well head to carry out workover of a producing well. Assembly of the derrick section by section is done from the bottom to avoid climbing the derrick. Guy wires are affixed to assure a vertical derrick. Assembly and disassembly is by section so that the derrick system is then portable.

19 Claims, 6 Drawing Sheets 18
30
20
23
21
22
10
25
23
22
26
12
16
24
11
15

FIG. 6
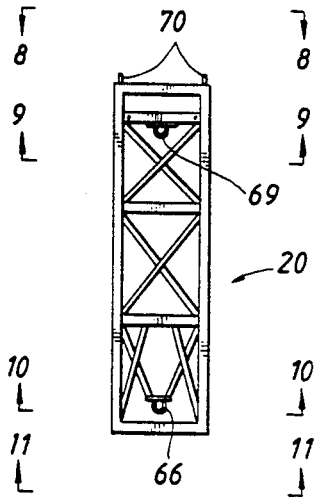
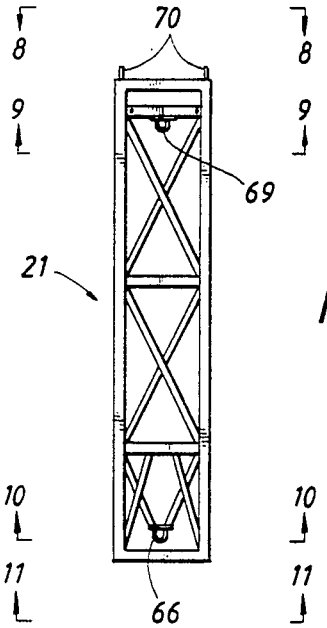
FIG. 7
FIG. 8
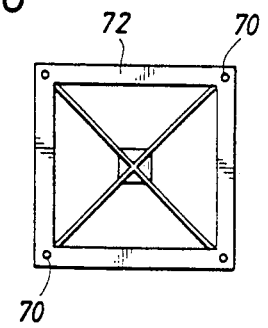
FIG. 9
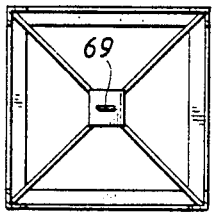
FIG. 10
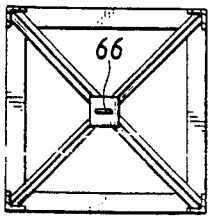
FIG. 11
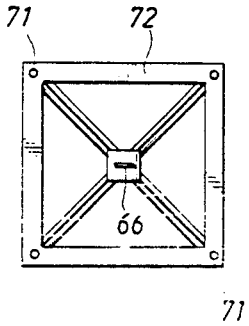

FIG. 12
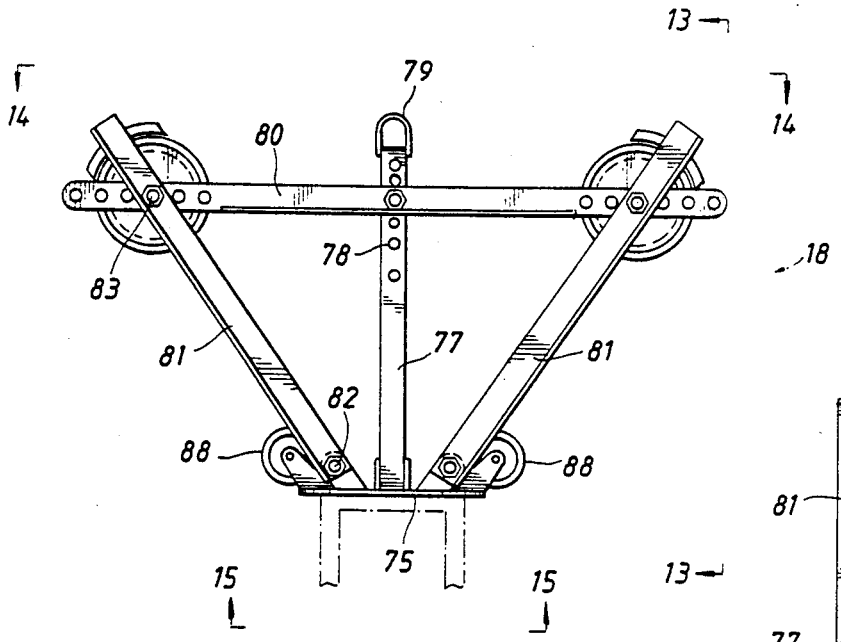
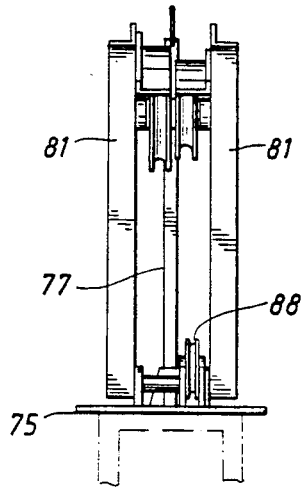
FIG. 13
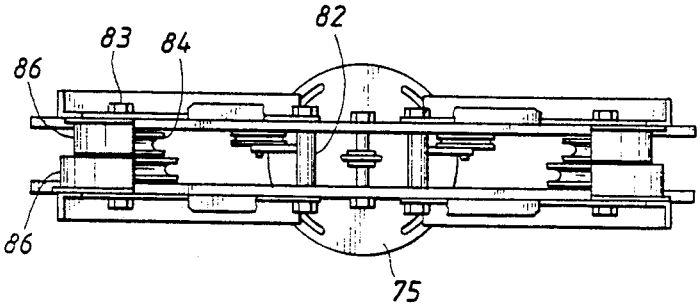
FIG. 14
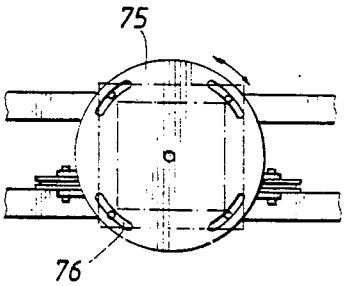
FIG. 15

METHOD FOR OFFSHORE RIG UP PLATFORM PORTABLE MAST

BACKGROUND OF THE DISCLOSURE

After a well has been drilled to produce oil or gas and the well is placed in service, it is normally necessary to provide periodic maintenance or service to the well. This is often carried out by use of a device commonly known as a workover rig. A typical workover rig sometimes is too large for routine or small maintenance jobs which may only require one or two days to execute. To place things in perspective, a typical drilling rig is sufficiently tall to hold three joints of pipe which are about 90 to 93 feet in length. Accordingly, the drilling rig is taller, measuring from the rig floor to the crown block. It is not uncommon for drilling rigs to be 130 feet in height. A workover rig is typically tall enough to handle production tubing above the rig floor. If the tubing is provided in 30 foot lengths, and the workover rig is intended to be on site for several days, a large workover rig is sufficiently tall enough to pull and stand two joints of tubing, perhaps even three joints. However, most workover rigs are relatively short and handle a single joint of tubing is permitted to stand in the rig. This requires a rig standing perhaps 40 to 45 feet in height. When rigs are this small, they typically can be constructed on the back of a truck, pivotally mounted so that they can stand upright when required, and folded horizontally to enable the truck to travel the highways. This defines a truck which is sufficiently low when the rig is folded down that it can travel down the highway within the length restrictions permitted for the truck. Regrettably, a truck mounted workover rig is not always available for every location.

There are many locations which cannot be reached by a long workover rig traveling down the highway on a truck. As an example, there are rig locations in swamps or remote areas where there are not adequate rural roads available to get to the site of the well that requires servicing. There are wells located in offshore waters where the well connects to a small platform located in a few feet of water. In many shallow regions, it is not uncommon to build a single platform for the well. This of course is to be distinguyshed from the large platforms erected miles out into the Gulf of Mexico to a locate as many as 30 or 40 wells drilled from a single platform utilizing deviated welled drilling techniques to extend the wells from such a platform into the producing formations.

The present disclosure describes a structure which can be used for workover. It is a structure which does not require a long truck traveling down the highway. Rather, it is a structure which can be mounted on a much smaller pallet for truck transportation to and from remote well sites. It provides a package which can be mounted on a relatively small skid moved by a boat, barge and even by helicopter to remote sites. It is a package which assembles and disassembles so that it can be erected on site, thus providing a small package for easy transportation to and from the remote location. The present disclosure is particularly advantageous in that it sets out a workover rig which can be erected at the site of a workover job and can be used to handle relatively long tools. If the tool to be placed in the well during workover is relatively short, a modest gin pole can be erected above the well head. However, there are difficulties in accomplishing this. For one, the well normally is operated at an elevated pressure, the pressure being as much as several thousand psi above atmospheric pressure. This of course depends on the particular formations that have been drilled and the pressure which is observed in the well at the well head equipment. Where there is substantial pressure in the well, it is necessary to use a device known as a lubricator or stuffing box to enable the operators at the surface to insert tools into the well. Where there is almost no pressure differential, the lubricator or stuffing box is relatively short. Whether the stuffing box is long or short, it is first affixed to the well head equipment to enable entry at the top end of the stuffing box. In that case, the lubricator positions the point of insertion of the service tools or equipment well above the platform, deck or other working area adjacent to the well head equipment. That requires a gin pole of substantial length, typically sufficiently tall that a gin pole simply will not do. Even more difficult than that, the length of the tool to be inserted through the stuffing box is a material factor. If for instance the well head equipment stands five feet above the working platform at the well head, and a stuffing box must be attached to it which adds another feet in length, immediately difficulties arise for the personnel getting to the point of entry of the tools to be inserted into the well. If the service equipment is quite long, 20 or even 30 feet for some tools, then the service personnel are required to insert an extremely long tool into the opening of the stuffing box at a height well above the working area.

The present apparatus is able to accomodate such heights. Indeed, it is a system which can be assembled from parts used repetitively at the site of the well and can be constructed to heights. In one job, this equipment can be used to provide an overhead structure which stands 30 feet tall. At the next job it can be extended to 60 feet, and at the next job it can be extended to 90 feet, just citing three representative heights. The equipment of this disclosure can be rigged up in relatively short order. Moreover, it is equipment which is rigged up so that it can be assembled to the selected height, used for a few hours, disassembled and then stored on a pallet or skid, hauled by truck or barge as mentioned, thereby enabling the next job to be carried out.

One of the advantages of the present apparatus is that the height of the tower can be extended without load loss. There are some service tools which impose a line load limit on the equipment. Assume for instance that a 500 pound tool is to be lowered into a well for operation. Assume further that the maximum pull which can be applied to the line in the well is limited to 1,000 pounds, or a total of 1,500 pounds of load. This load must be handled by a line which extends through the well, through the well head equipment, through the stuffing box and over the temporary derrick which is provided by the present disclosure. That load is derrick. The line loads the derrick from the winch typically located up the derrick and then over a sheave at the top of the derrick and down into the well. As the derrick is extended to greater heights, there is a requirement for guy wires to be tied to the derrick. If the guy wires are anchored at the top of the derrick, and if they are pulled with substantial tension, this adds compressive loading to the derrick and decreases the load that can be carried by the derrick from the load line. The present apparatus incorporates a system whereby the load on the derrick by the means of guy wires to maintain the derrick vertically, to resist wind gusts, and overcome other dangers, is partly placed on an upstanding part of the structure which is not part of the derrick. As will be explained in detail below, this type of guy system ties a set of guy wires to an upstanding member which aligns the derrick sections. The downward pull of the guy wires on this member can be quite high but this load is not added to the derrick load. The derrick merely rests within it, but alignment is accomplished it so that the derrick is free of loading from the guy wires which assure vertical alignment. An additional set of guy wires can then be tied to the derrick from the top to extend outwardly, but the downward load on this set of guy wires is held to a minimum. This set of guy wires assures that the top is positioned above the bottom of the derrick for vertical alignment. Nevertheless, extreme loads are placed elsewhere, not on the derrick.

One of the advantages of the present apparatus is that it enables the system to be assembled without requiring climbing to the top of the derrick to do this. The personnel who assemble the derrick can assemble a tall derrick, for instance, one that is 60 feet tall without having to climb to the top of the derrick. It is assembled section by section from the bottom. Accordingly, this requires that the personnel climb only about 12 to 15 feet. An appropriate catwalk is provided at the necessary height. Personnel safety is markedly enhanced. Each section of the derrick that is added is then added at the bottom. As each section is added, the derrick is extended but the personnel involved in the assembly are not required to go any higher than the catwalk. Rather, they can remain at this low elevation. When their work is accomplished, they can then dismount the catwalk and carry out the well service procedures without having to climb to the top of the derrick.

The present apparatus is summarized as a derrick incorporating an integral construction mechanism which permits erection of the derrick structure section by section. First, a base is installed. The base constructed so that it has appropriate degrees of freedom which permit pivoting, there being two axes of rotation at right angles so that leveling is obtained for the rectangular structure at the base. It is leveled, ideally using a bubble level, thereby assuring that the derrick will be erected with a true vertical angle. The base, after assembly and installation on a level reference, then supports an upstanding heavy frame structure of significant height denoted herein below as the launcher. So to speak, it is a guyde mechanism which is anchored to the base and is then tied with a number of guy wires. The several guy wires connected to the launcher can be pulled extremely tight to assure that the launcher is well anchored in position. Compressive loading in the launcher can be quite high but that does not impart any loading whatsoever to the derrick. Rather, the launcher is provided with a door which permits section by section insertion of the derrick into the launcher. The launcher additionally incorporates a mechanism which reaches down into the launcher to lift and hold a section of the derrick. The launcher incorporates a lift mechanism of limited travel which raises the sections of the derrick. As the first and then the second and then the last sections are inserted, each being assembled from the bottom, the launcher then extend the partially completed derrick upwardly from the bottom. Each section that is added into the launcher is vertically aligned by the launcher. Sections are joined together with quick release mechanisms to enable easy assembly in the field. There is a turn table which is affixed to the top derrick section. That turn table supports appropriate sheaves as will be described which enable the load lines to be correctly routed from the ground located winches which operate the load lines. As the sections are added to the derrick and as its length is extended so it becomes taller, it is raised above the launcher. Every connection required at the launcher is made complete so that the personnel need not climb up the derrick during assembly of the derrick. Likewise, at the time of disassembly, the derrick is taken apart from the bottom and the sections are removed from the launcher for easy storage. The entire derrick is disassembled and stored without requiring climbing above the launcher. The launcher itself supports a small overhead gin pole to enable each section to be handled while on the exterior of the launcher, and there is additionally a hoist mechanism on the interior of the launcher. That is used for raising the partially assembled derrick aligned with the launcher. In addition, the launcher supports foldable catwalk or deck members at the top end which are relatively low and therefore which do not have the risk involved with great heights. The launcher additionally supports a door which enables latching of the sections of the derrick on the interior of the launcher. The door can be opened and closed as sections are placed in the launcher.

DETAILED DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 6 is a side view of a short section of the derrick particularly illustrating upper and lower eyelets for cable connection as will be described in the assembly of the derrick;

FIG. 7 is a long section which is otherwise similar to or identical to the short derrick section shown in FIG. 6;

FIG. 8 is a plan view of the derrick sections shown in FIGS. 6 and 7;

FIG. 9 is a sectional view along the line 9—9 of both FIGS. 6 and 7 showing details and construction of the upper derrick section;

FIG. 10 is a sectional view through both FIGS. 6 and 7 along the lines 10—10 showing the lower eyelet in the derrick sections;

FIG. 11 is a lower end view of both the short and long sections illustrated in FIGS. 6 and 7;

FIG. 12 is a side view of the turn table and support structure at the top of the derrick for the sheaves which function as the crown block;

FIG. 13 is an orthogonal view to the structure shown in FIG. 12 showing the turn table and crown block mechanism;

FIG. 14 is a plan view looking down on the turn table mechanism of FIG. 12 wherein portions are broken away to show the interconnected braces of the structure;

FIG. 15 is a bottom view looking up at the turn table illustrated in FIG. 12 showing how the structure is aligned;

Figure 16:
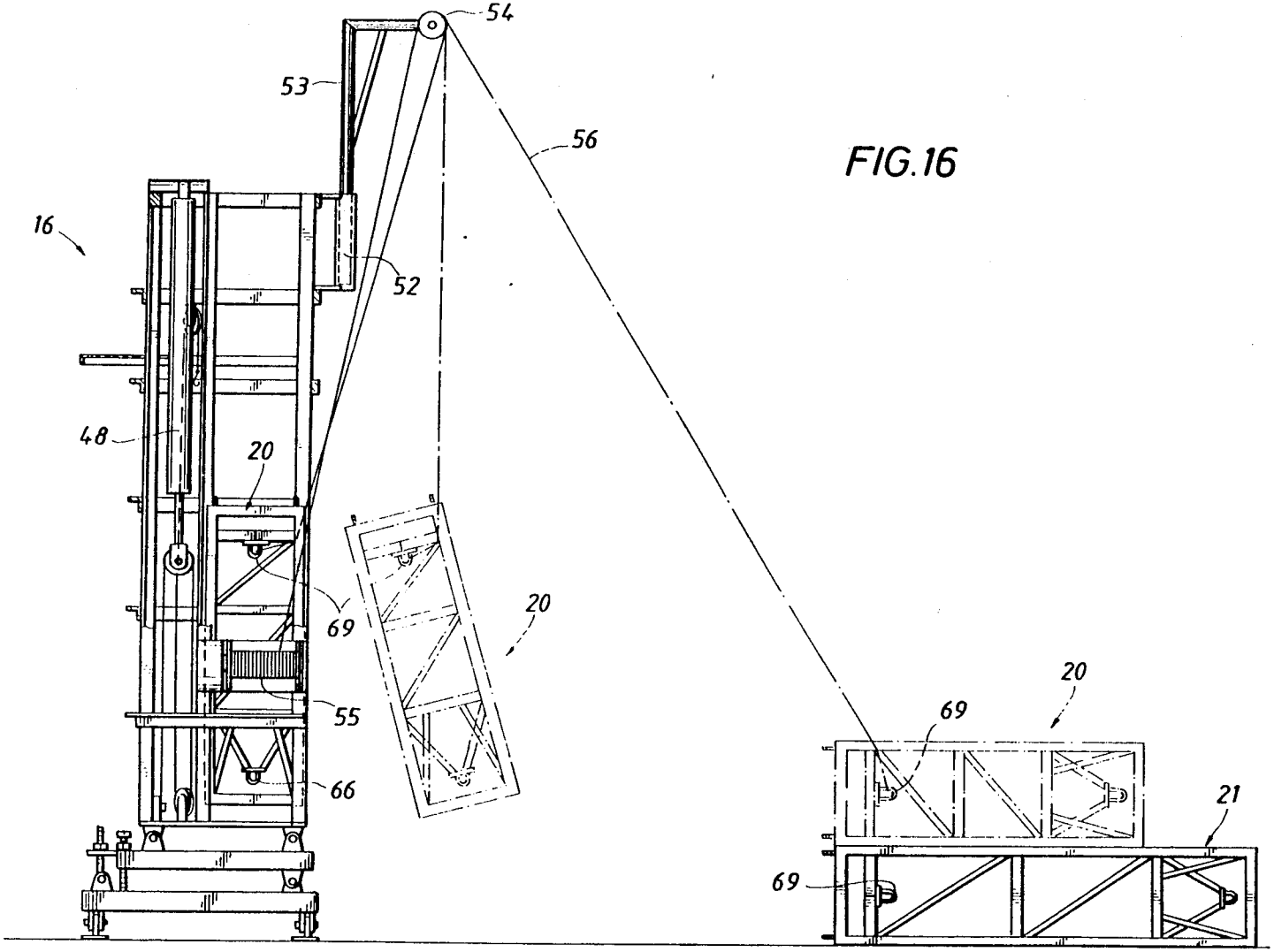
Figure 17:
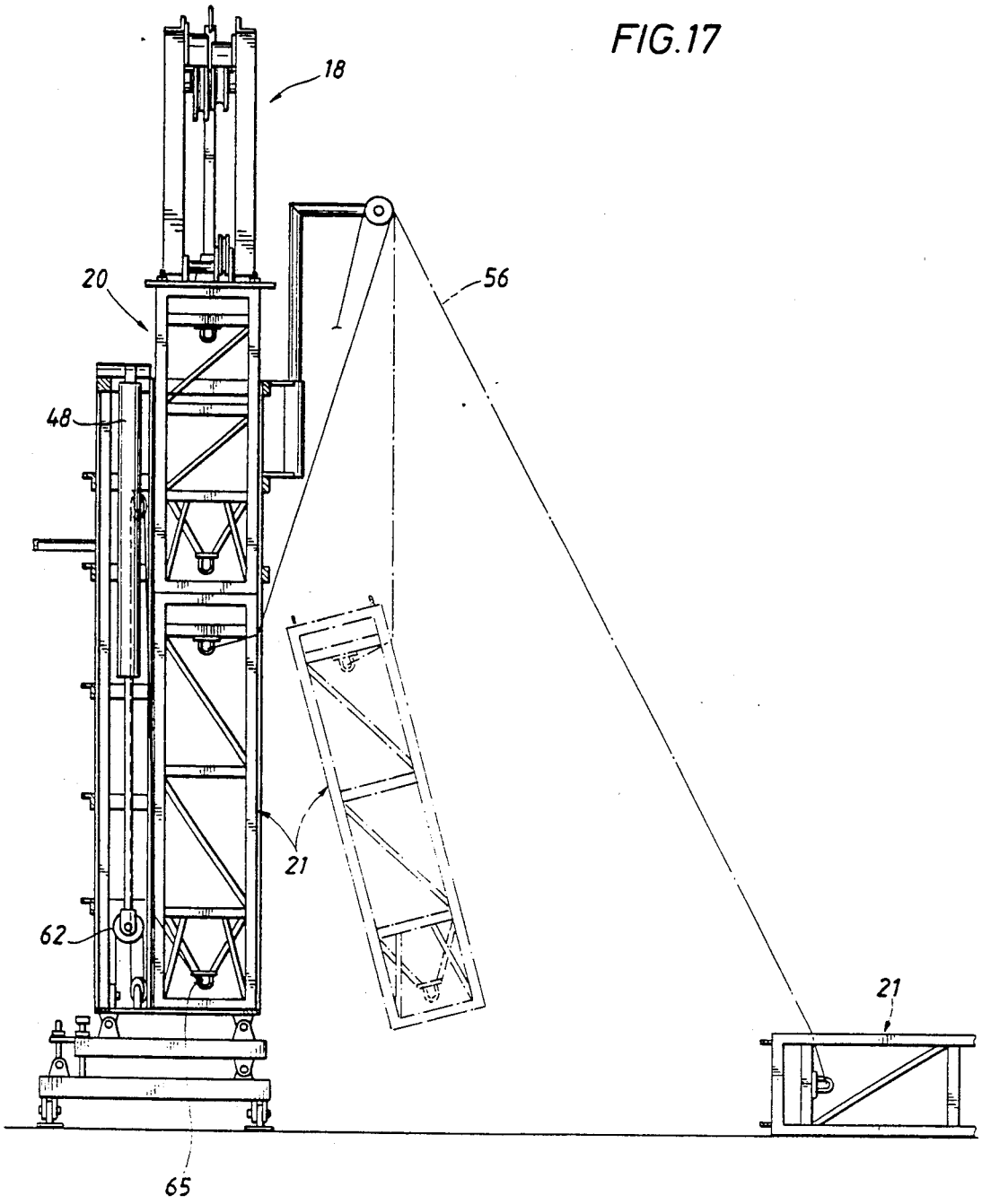

FIG. 16 shows the launcher of the present disclosure supported on the base and operated with a winch to move a short section into the launcher as the beginning step in erection of the derrick; and FIG. 17 is a view similar to FIG. 16 showing the partially assembled derrick wherein the short section has been raised by the launcher, a long section has been placed below the short section, and the turn table and supported sheaves are affixed to the top of the short section in assembly of the derrick from the bottom.

DETAILED DESCRIPTION OF THE PREFERRED EMBODIMENT

Figure 1:
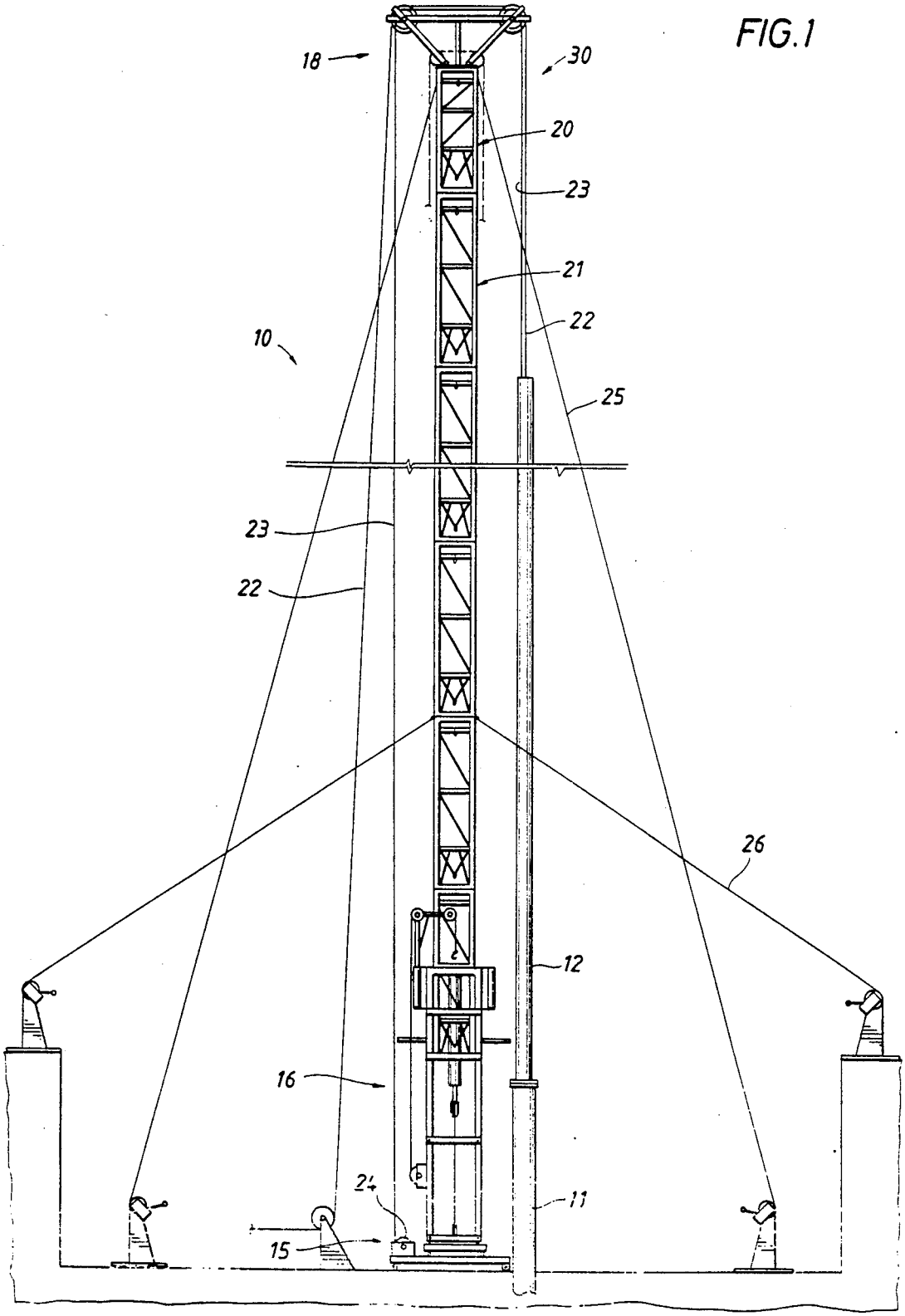
FIG. 1 is a side view of the launcher and derrick of the present disclosure rigged for a workover job and supporting a lubricator above a well head on load lines connected with the derrick.

Attention is now directed to FIG. 1 of the drawings which shows the completed derrick and related equipment at a well for service operations. So that the context will be understood, several of the important aspects relating to the site of operation will be given with respect to FIG. 1. Thereafter, the other views will be utilized in describing the invention of the present disclosure. This disclosure sets forth a derrick system generally identified by the numeral 10. This is used with a well which requires maintenance or workover, the well being topped by the well head equipment 11. Quite obviously, that has been simplified for sake of clarity of the drawings, the well head equipment 11 including the equipment often known as the Christmas tree connected at the top of the well. In the immediate area, the support surface can be large and expansive on the one hand or non-existent on the other hand. The Christmas tree equipment may be attached to the stub pipe emerging from a ground location where the work personnel can simply walk around the well head. Alternately, it can be at the center of a small deck or work area as might occur in a swamp or shallow water location. Whatever the fact, the numeral 11 represents the top of the well and it is the well head equipment sometimes known as a Christmas tree and which has been represented in simplified fashion in these drawings. Assuming that the well is operated at a substantial raised pressure, the system thus includes a stuffing box or lubricator 12 which is affixed to the top of the well head equipment. Since it is tall, it is supported by a load line as will be described. A tool (not shown) is inserted into the stuffing box so that it can be inserted into the well. That is also supported on another load line, and the derrick 10 of this disclosure therefore is required to support two load lines.

This apparatus utilizes a base 15 which supports the launcher 16. The launcher is hollow along its length and has an open side which permits the derrick sections to be placed in it. The derrick sections are identical other than the top section. Accordingly, each derrick section will be described in the same fashion. As detailed in FIGS. 6 and 7, the derrick sections are defined as a long derrick section which is the common building block for the structure. Therefore the top derrick section 20 is the short derrick section, and the long derrick sections are identified by the numeral 21. The top of the derrick is a single assembly which is illustrated in detail in FIG. 12 and related views and that will be described as the crown assembly 18. In sequence of assembly, the crown assembly is on the top of the derrick. The short derrick section 20 is just below it, and the long derrick section 21 is below that. Greater height is obtained by the use of multiple derrick sections 21.

The crown assembly 18 includes sheaves symmetrically positioned to the left and right as illustrated. This enables support for two load lines 22 and 23. The load line 22 is shown extending toward the base 15 and connects to the side to a powered winch which is not shown. The load line 23 connects with a winch 24 which is supported on the base as illustrated. Since two load lines are provided, it is necessary to have two winches for operation of the load lines. As will be further understood, the load line 22 passes over the crown assembly 18 and extends downwardly into the well to support the tool used in well service. That tool can be any kind of workover equipment capable of carrying out the tasks assigned to it, and typically having a weight of several hundred pounds. By contrast, the load line 23 provides a means and mechanism for supporting the stuffing box 12 which is aligned with the well and is affixed to the well head equipment 11.

Figure 2:
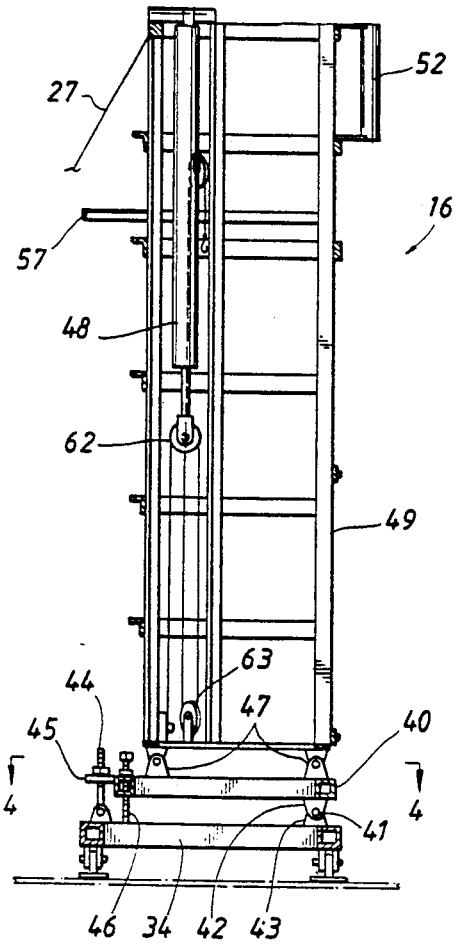
FIG. 2 is a side view, partially in section, of the launcher of the present disclosure showing the construction of a mechanism for raising the derrick and comprising a hydraulic cylinder which is extended and retracted for raising and lowering the derrick.

FIG. 1 shows a first set of guy wires identified by the numeral 25. An intermediate set of guy wires 26 is also included. They are all connected with appropriate winches which are moved to the side of the installation sufficiently to have an appropriate angle. It is important to note that they are attached as the derrick is assembled and raised so that it is not necessary to climb the derrick for attachment of the guy wires 25 and 26. They connect with hand cranked winches which are located at these locations and which also include locks so that the winches can be locked against unintended rotation. The pull on the lines 25 and 26 is kept to a minimum. One reason that this can be done is that the launcher 16 is also connected with a set of guy wires which have been omitted from FIG. 1 for sake of clarity. The guy wires connected to the launcher are pulled tight. They can be pulled tight because the guy wires associated with the launcher are not connected to the derrick. Compressive loading on the launcher is achieved by the guy wires 27 in FIG. 2 of the drawings. Indeed, there are preferably four of these and they also connect to a supporting frame or at other locations around the well head equipment 11. As an example, they typically connect with a supporting frame or deck associated with water located or swamp located well heads. Alternately, they can be connected with a supportive skid for support of the hydraulic motors, winches and other equipment necessary to power the load lines 22 and 23. Since FIG. 1 is somewhat crowded near the bottom of the derrick, the load lines 22 and 23 are illustrated but the guy wires 27 have been omitted from that view and are shown in FIG. 2 of the drawings. In the preferred mode of operation, while the guy wire 27 can be a cable, it is preferable to utilize link chains with boomers for tightening the link chains.

As a generalization, the numeral 10 identifies the entire system while the erected derrick, that part of the structure which is within the launcher 16 and which stands upright as illustrated in FIG. 1 of the drawings will be referred to utilizing the reference numeral 30.

DESCRIPTION OF THE LAUNCHER AND LEVELING BASE ASSEMBLY

Figure 3:
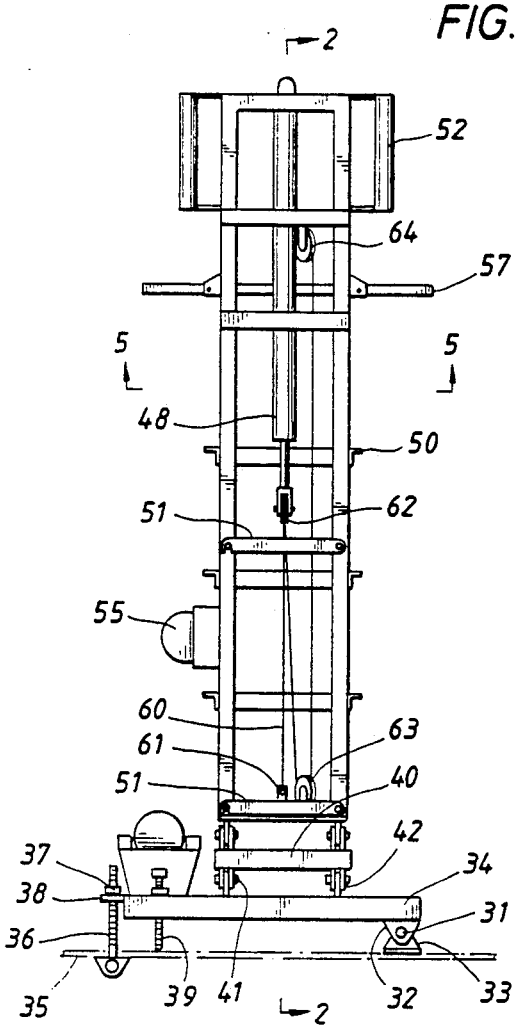
FIG. 3 is a view at right angles to FIG. 2 which shows in side view the launcher and particularly the door mechanism at which sections of the derrick are inserted into the launcher for erection.

Going now to FIGS. 2 and 3 of the drawings, the launcher is shown there in greater detail. As will be noted on careful review of FIG. 2, the structural members which are normal to the plane of the view are shown in section indicating that FIG. 2 is taken along a sectional cut line through the middle of the apparatus as further emphasized by the location of the cut line 2—2 in FIG. 3. This structure is sized to receive the derrick sections 20 and 21. The structure is sized to support that load. The load is placed on the base, the base 15 shown in greater detail in FIG. 4 of the drawings. Going to FIG. 3, the numeral 31 identifies a mounting axis of rotation having the form of short mounting bolts engaged by parallel protruding clevis means 32 which anchor to matching tabs at 33. This anchors and determines the axis of rotation. The axis of rotation at 31 supports a rectangular frame 34 having four sides which are at right angles and indeed which can be a rectangle or square. The structure is shown cooperative with a support deck or plate 35 which is represented in dotted line. As will be understood, this may be at the well head site, or it may have to be improvised depending on the conditions which are found when the derrick equipment 10 is delivered to the location. Whatever the circumstances, a support or base plate 35 is utilized to provide a certain anchor for the axis 31 which serves as an axis of rotation whereby the base is anchored. Assuming therefore on the availability of the plate 35 or a corresponding equivalent structure, a tension bolt 36 is anchored to it, and the nut 37 is adjusted to firmly engage a protruding eyelet 38 which enables tension to be applied to pull the base down. In cooperation with this, a leveling bolt 39 is threaded to the base frame 34 and is extended by a distance controlled by adjustment of the bolt relative to the frame so that the frame is brought to a horizontal position as will be detailed. As further illustrated in FIG. 4 of the drawings, the frame 34 provides a support structure for the winch mechanism generally indicated at 15.

Figure 4:
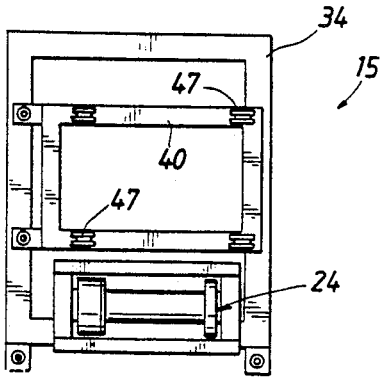
FIG. 4 is a sectional view along the line 4—4 of FIG. 2 showing details of construction of the base under the launcher which is used to level the structure to assure vertical alignment of the derrick.

The frame 34 is shown in FIG. 4 of the drawings to be relatively large, even wider in both dimensions than the launcher 16 which is supported above it. The frame 34 is the bottom most part of the structure, and is supported on the axis 31 for rotation to provide a single degree of freedom to the equipment. The frame 34 is made of sufficient structural strength to hold the weight of the launcher which requires that it provide a stable foundation to the launcher. Accordingly, at the time of installation, the frame 34 is appropriately leveled and the next step involves leveling of the structure there above as shown in FIGS. 2 and 3.

The numeral 40 identifies a similar frame which is located above the frame 34 but which is located for pivotal movement about an axis at 41 which is at right angles to the axis 31. As illustrated, the axis 41 involves the clevis 42 cooperative with the tab 43 as detailed in FIGS. 2 and 3. The rectangular frame 40 is thus pivoted about the axis 41 but is fixedly held when leveled by an anchor bolt 44 cooperative with an eyelet 45 which is similar in construction to the eyelet 38 just mentioned. Again, a bolt 46 is adjustable to level the frame 40 with respect to the frame 34.

By appropriate adjustment of the bolts in the base 15, a level platform can be provided to support the launcher 16. The launcher 16 is supported on the rectangular frame 40 as illustrated and stands upright above it. The base 40 incorporates the appropriate adjustments in two dimensions at right angles to each other so that leveling can be accomplished even though the support surface is not level. This can be tested by the use of a bubble level during installation so that the launcher 16 is appropriately attached in the upright position. The launcher 16 is supported on an appropriate clevis mounted mechanism 47 shown in FIGS. 2 and 3 above the base. At the four corners of the frame 40, these connectors are shown at FIG. 4 also. The launcher 16 is constructed with parallel upstanding frame members, and supports on the interior a double acting hydraulic cylinder 48. The cylinder is parallel to the four frame members 49. There are horizontal frame members at various locations and they are generally indicated by the numeral 50. On one side, the frame members 51 open and close to form a door. The several which form the door are located on a common side to provide a door opening of sufficient height as will be described. Moreover, the launcher supports two or more mounting tubes 52 at various locations at the top end of the structure. The mounting tubes 52 are utilized in supporting an upstanding gin pole 53 shown in FIG. 16 which locates a pulley 54 at an appropriate location for easy installation of an overhead hoist. The overhead hoist involves the use of a winch 55 shown in FIG. 3 of the drawings. The cable from the winch is routed to the pulley 54 and is then used to move various components, the use of the working cable 56 being represented in FIGS. 16 and 17 considered jointly. Returning however to FIGS. 2 and 3, it will be further observed that the launcher includes a catwalk of folded construction. The catwalk, better shown in FIGS. 3 and 5, incorporates a hinged deck of expanded steel identified at 57. Duplicate catwalk areas are included on the left and right.

Figure 5:
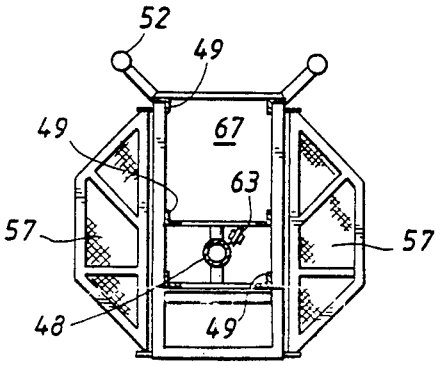
FIG. 5 is a sectional view along the line 5—5 of FIG. 3 showing details of construction of the launcher and catwalk attached to the launcher.

FIGS. 2 and 3 together show that the launcher is axially open to receive the derrick sections 20 on the interior. The sectional view of FIG. 5 shows the open area parallel to the hydraulic cylinder 48. The hydraulic cylinder 48 is supported vertically, being provided with an anchor at the upper end. The hydraulic cylinder serves as a controlled mechanism for raising the derrick sections 20. The hydraulic cylinder 48 is shown with a double acting piston rod extending from it which is involved with cabling as will be described. Briefly, a wire rope 60 is provided with a dead end anchor 61 in FIG. 3; the wire rope 60 extends upwardly to the sheave 62 which is moved by the hydraulic cylinder 48. The sheave 62 routes the wire rope from the dead end 61 upwardly to the sheave 62 and back down to an anchored sheave 63 which is immediately adjacent to the anchor for the dead end 61. The wire rope then extends upwardly to another sheave 64 at the top of the launcher, and provides a connective hook or eyelet 65 at the moveable end of the wire rope 60. With the sheave hydraulically raised to the maximum height as shown in FIG. 2 of the drawings, the hook is raised as shown in FIG. 2. When the sheave 62 is moved downwardly through a specified stroke resulting from operation of the hydraulic cylinder 48, the hook then moves downwardly by a distance which is double the travel of the sheave 62. If the sheave 62 has a stroke or a range of travel of one foot, then the hook is two feet.

This hook 65 is used in moving derrick sections upwardly. For a better understanding of this at this juncture, attention is momentarily directed to FIG. 17 of the drawings. There, the hook 65 is shown connected to a bottom eyelet 66 which is also identified in FIGS. 10 and 11 of the drawings. The hook is connected with the derrick section at the eyelet 66 to raise the derrick section. Dwelling for the moment on FIG. 17, when the hydraulic cylinder retracts the piston rod and raises the sheave 62, the travel of the sheave raises the derrick section 20 which is on the interior of the launcher. As noted, the travel is in a proportion of 2:1 as a result of the routing of the wire rope 60 previously defined. Returning again to FIGS. 2–5, the launcher is shown with six structural members 49 standing upright, and four of them define an axial passage through the launcher. This passage will be identified generally by the numeral 67 (see FIG. 5) and will be referred to as the derrick location. Looking down the derrick location in the opposite direction of the sectional view of FIG. 5, it will be observed that the derrick 30 rests on the frame 40 shown in FIG. 4 of the drawings. In this deployment, the derrick 30 is appropriately supported by the frame 40 which was leveled as previously discussed. Loading (weight from the derrick) on the frame 40 is independent of the loading on the launcher. Recall that the launcher is anchored by the guy wires 27 (FIG. 2) which pull downwardly on the launcher. This assures that the compressive load applied to the launcher is not experienced in the derrick 30 itself. The derrick 30 can if desired be fastened by suitable nuts and bolts to the rectangular frame 40. It is however held in location by the upstanding launcher 16 which encompasses the derrick sections. The derrick is aligned within the launcher with substantially no lateral movement permitted. To this end, connection between the derrick sections will be described later and that mode of connection can be extended to the bottom most derrick section which is finally anchored to the frame 40 as will be detailed.

Attention is now directed to views 6–11 which will be discussed collectively. These several views show the derrick sections which are structurally identical but which differ only in length. That is to say, they are similar in strength, have identical cross sectional shapes as shown in these views and are all provided with two eyelets. Recall that mention was made of the bottom eyelet 66. This eyelet 66 is located at the bottom end to assist in raising the derrick. That is particularly important for engagement with the hydraulically powered lifting apparatus involving the wire rope 60. In addition, the derrick sections include an upper eyelet 69 near the upper end. Again, this is provided on the long and short derrick sections in all instances. The upper derrick eyelet is used in moving the derrick sections in the fashion required to unstack the derrick sections as illustrated in FIGS. 16 and 17. There, the upper eyelet 69 is used for connection with the working line 56 for maneuvering the derrick sections from a stored or stacked location to the side of the well into the launcher. More will be noted regarding this hereinafter.

Going back to FIGS. 6–11 jointly, the long and short derrick sections are identical in the provision of upwardly protruding alignment pins 70 which are located at the four corners of the derrick sections. They engage mating holes at the opposite end, the holes being identified at 71 in FIG. 11. This assures that the derrick sections stack together and will not slide to the side. By connection of the pins 70 into the matching pin holes 71, the desired alignment can be achieved. Additionally, adjacent sections are preferably fastened together by the use of suitable nuts and bolts which are attached immediately adjacent to the pins 70, these being omitted for sake of clarity of the drawings. Each end of the derrick section is formed of a rectangular frame 72. This is duplicated at both the top and bottom end. Suitable frame members form a lattice structure so that the upstanding derrick sections are relatively strong. They are formed of lightweight materials but they are more than sufficiently strong to handle the load that is applied to them. Summarizing therefore the structures which are shown in FIGS. 6–11 collectively, they show identical sections which differ only in length. They are in both instances constructed with the appropriate lattice connections between the lengthwise members so that strength is provided against bending and flexure. Moreover both the long and short derrick sections include the lower eyelet 66 and the upper eyelet 69 for connective purposes. They are joined serially by aligning the pins 70 with the matched opening 71, and adjacent sections are then additionally connected by suitable nuts and bolts (omitted from the drawings). The derrick 30 is thus assembled out of the derrick sections just described.

CROWN ASSEMBLY

Going now to the several views which show the crown assembly indicated by the reference numeral 18, FIG. 15 of the drawings shows a circular turn table 75 which is constructed with a number of slots 76 which match the pins 70 shown in FIG. 8 of the drawings. The pins 70 are located at the top end of the derrick 30 and are positioned in the arcuate slots 76. This permits the turn table to rotate through a suitable angle of rotation. This provides approximately 30° to 40° of rotation. This rotation enables the sheaves as will be described to be aligned immediately above the well head equipment 11 illustrated in FIG. 1. Accordingly, this overhead alignment is a means permitting the positioning of the load lines where they are pulled vertically and do not have to pull to the side. The overhead lines extending downwardly into the well and connecting with the stuffing box as shown in FIG. 2 are not twisted because they can be aligned by rotation of the turn table. In FIG. 12 of the drawings, the turn table 75 supports an upstanding structural brace 77 which has a number of spaced drilled holes 78. These are located at different locations or heights along the brace 77. The brace 77 is provided with an eyelet 79 at the top end for easy handling during assembly. Moreover, the openings 78 are located so that horizontal braces 80 can be connected to the upstanding brace 77. The brace 77 is fixed so that it is perpendicular to the turn table. The brace 77 is an anchor to prevent wobble of the four sides which make up the supportive frame work as will be described. Specifically, a lateral brace 81 extends to the side, this being duplicated on both the left and right. In fact, there are four lateral braces, this being an enhanced construction better shown in FIG. 13 of the drawings where the lateral braces 81 pivotally mount on the shaft 82 for rotation jointly. The lateral braces 81 intercept the horizontal brace 80 to support a shaft 83 which in turn mounts first and second sheaves. As shown in FIG. 14, a small sheave 84 is positioned immediately adjacent to a larger sheave 85, and they rotate in a free wheeling fashion on the common shaft 83. Cable guards at 86 and 87 are included so that the cables are not permitted to jump out of the sheaves in the event that slack were to be encountered during manipulation of the two load lines. These sheaves are provided for the load lines 22 and 23. As illustrated in FIG. 3 of the drawings, both load lines extend up to the sheaves on the left as shown in FIG. 12 and the lines extend across to the sheaves on the right and extend downwardly.

The construction shown in FIG. 12 of the drawings permits the positioning of the sheaves 84 and 85 at a specified lateral distance. This distance is duplicated by moving in symmetrical fashion the two lateral braces as extended. Referring to FIG. 12, for nomenclature sake, the equipment has left sheaves and right sheaves to distinguish the apparatus.

In application, the spacing of the left and right sheaves is controlled by the positioning of the horizontal brace 80. As it is raised or lowered, it is connected to the vertical brace 77. This however permits repositioning of the shaft 83 which has the form of a bolt which is positioned through the various frame members as shown and which supports the two sheaves. Moreover, this is done symmetrically left and right. Accordingly, this ready deployment can be achieved in the crown assembly 18 so that the lines extend upwardly parallel but spaced from the derrick. Fixed sheaves at 88 are included for routing of an emergency line. FIG. 1 shows the routing of an emergency line utilizing the sheaves 88. It is immediately adjacent to the assembled derrick 30, and extends parallel to the derrick on two sides of the derrick. The emergency line is provided for that purpose. It is not normally used. If the need arises the emergency line can be used to raise or lower a person on the derrick, for instance, to work with the tool that is being lowered into the stuffing box 12. The emergency line can be used to raise or lower personnel or equipment. It is available primarily for emergency purposes, and thus permits a person to go up the derrick utilizing appropriate safety belts in conjunction with the emergency line.

FIELD INSTALLATION OF THE DERRICK SYSTEM

Assume for purposes of discussion that the derrick system 10 of the present disclosure is to be installed at a field location. In this regard, assume further that the well head equipment 11 extends about 8 feet above the surrounding surface and assume that the surrounding surface either includes or lends itself to installation of a metal framework. This framework can be perhaps 4 feet square, perhaps have dimensions of 10 feet or any other dimension that would be typical for a surrounding work area defined by a platform. In this platform area, the various and sundry guy wire winches are laid out near by. They will ultimately be anchored as the guy wires are made taut. Moreover the first step involves the mounting of the launcher 16 and to this end, reference is made to FIGS. 2–5 collectively. The base 15 is therefore installed. It is installed by anchoring so that there are the two axes of rotation as mentioned and the adjustments are made at the threaded members shown in FIGS. 2 and 3. They are both adjusted utilizing a bubble level to assure that the base 15 is properly leveled. Once it has been leveled, the stop bolts 39 and 46 are adjusted and fixed to assure that the level condition is held. A firm footing of course is required to accomplish this. That is, the derrick should not be erected on a soft area. Rather, it is preferably erected on a wooden or metal deck or other framework that is suitably rigid and stiff to enable proper anchoring of the system. Once leveling has been accomplished, and once this is assured by operation of the base leveling mechanisms shown in FIGS. 2 and 3, then the launcher is ready to be anchored.

The next step in the procedure is to anchor the launcher with the guy wires 27. As mentioned, the preferred form of anchoring device is a link chain with a boomer connected at the distal ends. This enables the tension to be adjusted in four of the chains which are deployed at suitable angular locations with respect to the launcher 16. Again, the taut condition of the guy wires 27 imparts a compressive load but this load is not experienced by the derrick 30 itself; rather, this load is isolated solely in the launcher 16.

The next step in the procedure is to install by hand the overhead gin pole member 53 which supports the pulley 54 at a location enabling the winch 55 to deploy the working line 56. As illustrated in FIG. 16 of the drawings, this step is then done by personnel on the catwalk (see FIG. 5) who position the working line 56 so that the derrick equipment can be moved one section at a time. As further illustrated, the gin pole 53 is anchored in the socket 52 which is provided for that purpose so that the derrick sections can be moved to a location for assembly in the launcher. The working line 56 is connected with the upper eyelet in the short section 20. The upper eyelet 69 is provided for that purpose. By operation of the winch 55, and especially noting FIG. 16 of the drawings, the short section 20 can be moved from a stacked location off to the side. It is hoisted in the air and is aligned with the pins 70 at the upper end. The short section 20 has a height which enables it to fit in the door and it has a cross sectional size to enable it to fit in the axial passage 67, see FIG. 5. In any case, FIG. 16 shows how the short section is pulled from a stacked location off to the side into a position immediately adjacent to the door in the launcher. The door is opened by rotating the moveable frame members 51. By hand, the short section is then pushed into the door and lined up with the frame 40 which provides support for it. By controlling tension in the working line 56, the short section 20 can be deposited at that location.

The next step in operation involves release of the working line 56. The next step is carried out by connecting the eyelet 65 at the end of the wire rope 60 to the bottom eyelet 66 of the short derrick section now captured in the launcher. Going momentarily to FIG. 17 of the drawings, the hydraulic cylinder 48 is extended and the wire rope is connected to the eyelet 66. This is illustrated in solid line in FIG. 17. Then, the hydraulic equipment is operated to retract the piston rod of the cylinder 48 and raise the sheave 62 (see FIGS. 2 and 3 jointly) which movement raises the short section vertically. It is raised so that the upper end of the short section extends above the top end of the launcher.

The derrick 30 is held in for assembly by adding the crown assembly 18 above the short section 20 and by installing a long section 21 there below. The next step preferably the installation of the long section 21 there below. At this moment, the short section is high in the launcher with sufficient clearance to receive the long section 21 below through the door of the launcher. This is accomplished by extending the working line 56 as shown in FIG. 16 to engage the long derrick section to the side and by pulling it over as shown in FIG. 17. It is pulled erect and then pushed into the door by hand. Once in the door, it is rested on the frame 40. While resting on the frame 40, the long and short sections in the launcher are aligned so that the pins 70 correctly line up with the openings 71 shown in FIG. 11, and the short and long sections are then brought together. This is accomplished by hydraulically moving the cylinder 48 to extend the piston rod slightly which permits the raised short section to be dropped slightly. It is lowered so that alignment is accomplished. Once the short and long sections are brought into contact with one another, the pin and pin hole connections are made, and additional fasteners such as nuts and bolts are used to anchor the short and long sections together. This completes the assembly of the short section 20 onto the long section 21. At this moment, they have the form shown in FIG. 17 and are resting on the base and particularly at the frame member 40.

The next step is to attach the crown assembly 18 to the top of the short section 20. The crown assembly 18 is lifted by the working line 56 in the same fashion as described for the other connective steps. It is raised so that a person on the catwalk can rotate the gin pole 53 and thereby maneuver the crown assembly above the short derrick section 20. The short derrick section 20 supports the crown assembly 18 which is moved to the aligned position and is connected with the appropriate pins (note FIG. 15) and the crown assembly is then rested at that location. Through the use of suitable nuts and bolts, the turn table 75 is anchored after it has been rotated. It is rotated so that the right sheaves at the top of the partially completed derrick 30 are immediately over the well head equipment 11. At this time, the turn table is fastened. It can be fastened, for instance, by using nuts and bolts to anchor it at a particular angular orientation. An arrow shown in FIG. 15 indicates that rotation can be imparted to the turn table through an angle sufficient to enable the alignment just mentioned, and the turn table is fastened and held fast. Also, the horizontal brace 80 is adjusted by raising or lowering its connection at the openings 78 in the vertical brace 77. Likewise, the lateral braces 81 are adjusted in angle to control the spacing of the left and right sheaves. Since this is a symmetrical construction, this can be accomplished quite readily whereby the two load lines 22 and 23 are held sufficiently out to the side that they do not become entangled with the derrick 30. This adjustment is made at the time of installation of the crown assembly 18 which is adjusted as described and which need not be changed after that. There is no need to service the crown assembly once it is installed and adjusted in height and width. Then, the crown assembly is ready to be used. This requires that the load lines 22 and 23 be extended from their winches which supply these cables and they are snaked through the appropriate sheaves at the foot of the derrick and are extended upwardly to the sheaves on the crown assembly (FIG. 12) and then are extended over and down toward the well head 11. Indeed, while assembly is being undertaken, the two working lines 22 and 23 can simply be tied off at some convenient location on the Christmas tree.

At this juncture, a complete derrick 30 has been assembled but it typically will be short. It is complete in the sense that it formed of two derrick sections supporting the crown assembly 18. For convenience, the length of the derrick sections is preferably made consistent from section to section. For instance, the short section can be 6 feet in length while the long section can be 8 feet in length; duplicated long sections are preferably made the same length. It is desirable that a short section be used so that the hand work required for the crown assembly 18 as illustrated in FIG. 17 is accomplished easily by a person standing on the catwalk. This therefore requires that the catwalk height be related to the height of the turn table 75 when the crown assembly is rested on the assembled short section 20 with one long section there below. As will be understood, dimensional variations can be made in the present apparatus without departing from the spirit of the disclosure. In any case, a complete assembled derrick 30 can comprise the crown assembly 18 and the two units which are shown in full line in FIG. 17. In the more typical situation, additional long derrick sections will be inserted. They are positioned in the following sequence. The hydraulic equipment including the cylinder 48 is operated to raise the derrick in the launcher. It is raised by moving the bottom most derrick section to a height which is limited by the travel of the hydraulic cylinder. If the piston rod is fully retracted, it imparts movement to the partially assembled derrick 30 in the launcher sufficiently that the door area is cleared so that another long section 21 can be inserted below the derrick 30. That is, the next long derrick section is engaged with the working line 56 and moved next to the door as shown in the dotted line position of FIG. 17. It is inserted through the door and positioned below the partially assembled derrick there above.

All of the partially assembled derrick weight is supported by the hydraulic cylinder 48 aligned within the launcher. The partially assembled derrick is lowered so that alignment is achieved and the pin connection is made. Again, nuts and bolts are used to fasten this third derrick section in place. The wire rope 60 is disconnected and is dropped for connection, and then connected with the bottom most derrick section shown in FIG. 17 and the partially assembled derrick 30 is again raised. This process is repeated as many times as required to add derrick sections. Each derrick section is inserted through the door, aligned with the partially assembled derrick there above, the pin connection is completed, the new derrick section is fastened by appropriate nuts and bolts, and the entire assembly is put together sequentially in this fashion. This raises the crown assembly to the required height. As it is being raised, the lighter gauge guy wires 25 and 26 are connected at suitable points along the anticipated height of the derrick. The guy wires maintain the upper part of the derrick true or vertical above the launcher with the application of very little compressive loading to the derrick. The guy wires 25 and 26 preferably connect with hand operated winches which have a winding position and an unwinding position. In addition, they have a neutral position at which the cable can be pulled from them. The amount of pull necessary to pull cable from the drum is adjustable, and a suitable back pull of less than 100 pounds is appropriate. Thus, as the derrick 30 is raised, the several guy wires are pulled, thereby enabling the derrick to be erected while maintaining the back pull tension in the several guy wires. This procedure is continued until the derrick 30 is brought to the requisite height. This may require the addition of two or perhaps 10 sections of derrick working from the bottom of the partially assembled derrick. Moreover this permits the height to be tailored to a requisite situation. Indeed, the height can be an intermediate value so that a lot of work can be carried out with a particular tool. Assume for instance that a work over tool is only six feet in length. If the next work over tool for the well is much longer, it might then be appropriate to utilize a stored derrick section 21 to raise the entire derrick. As will be understood, this is repeated so that the height of the derrick sufficiently clears the well head and stuffing box 12 that proper clearance is obtained.

Disassembly is accomplished by reversing the above described sequence. Disassembly involves connecting the wire rope 60 to the eyelet 66 and raising the derrick slighty. This connection is made to the derrick section next to the bottom section. In other words, if the derrick then comprises ten derrick sections, the wire rope 60 is connected to the ninth derrick section counting from the top. The entire derrick is then raised. The bottom derrick section (or the tenth section) is raised with it, but it is at a height such that the workers can quickly disengage the tenth derrick section. This frees it from the derrick and permits the tenth section to be removed through the door (opening the latches 51 shown in FIG. 3). After it has been moved to the side, the working line 56 can be used to deploy this derrick section off to the side. Removal typically involves use of the working line which is connected to the winch 55 (FIG. 3). Then, the derrick can be lowered. This step is carried out by extending the piston rod from the hydraulic cylinder 48. This lowers the derrick 30 as a result of removal of the tenth derrick section, and the process is then repeated to remove the ninth derrick section, then the eighth, and so on. Finally, when the derrick is so short that the crown assembly 18 is immediately adjacent to personnel on the catwalk, the crown assembly 18 can be dismantled and removed. The last two derrick sections are then removed from the launcher. At this juncture, all the equipment can be dismantled and loaded on a flat bed truck and removed from the locale. This enables quick assembly and disassembly of the derrick shown in FIG. 1. In fact, the derrick system 10 of this disclosure can be assembled in just two or three hours with two or three personnel. It can be assembled by incorporating as many as ten derrick sections. Disassembly can be accomplished just as fast.

While the foregoing is directed to the preferred embodiment, the scope thereof is determined by the claims which follow:

I claim:

1. A method of erecting a derrick to enable workover of a well which comprises the steps of:

(a) adjacent to the well head at the top of a well, temporarily anchoring a base;

(b) positioning on the base an upstanding, vertically aligned derrick launcher;

(c) positioning a derrick section in said derrick launcher in an upstanding, vertically aligned position;

(d) raising the first derrick section to an elevated position by a distance sufficient to enable a second derrick section to be positioned there below while supported by said derrick launcher;

(e) serially connecting the first derrick section with the second derrick section wherein the first and second derrick sections are aligned by said derrick launcher;

(f) adding sufficient derrick sections serially connected with the first and second derrick sections wherein each added derrick section is aligned with the previously installed derrick sections by said derrick launcher so that all of the derrick sections form a derrick supported by said derrick launcher; and (g) attaching a crown assembly including sheaves for ngaging a load line on the top of the derrick formed by the derrick sections.

2. The method of claim 1 wherein the step of anchoring a base includes the preliminary steps of fastening the base temporarily, adjusting the base about a first axis of rotation defining a first degree of freedom, adjusting the base with respect to a second axis of rotation defining a second degree of freedom and wherein the base is initially leveled.

3. The method of claim 2 wherein said base incorporates a rectangular framework to support the derrick sections thereon, and including the steps of leveling the rectangular framework so that the derrick sections are aligned therewith.

4. The method of claim 3 further including the step of placing the bottom most derrick section in the derrick to the rectangular frame.

5. The method of claim 4 wherein said rectangular framework is supported for movement by the above defined axes of rotation which are at right angles, and which axes parallel the rectangular framework, and further including tab means in enabling said rectangular framework to pivotally connect and lock in position when level.

6. The method of claim 5 wherein said derrick launcher is fixedly connected to said rectangular framework and extends upright thereabove.

7. The method of claim 6 including the step of opening a side door on said derrick launcher to enable the derrick sections to be inserted for alignment by said derrick launcher.

8. The method of claim 1 including the step of opening a side door on said derrick launcher to enable the derrick sections to be inserted for alignment by said derrick launcher.

9. The method of claim 8 wherein said derrick launcher is anchored in a vertically upright position and supported against lateral movement by attaching a set of guy wires thereto wherein the guy wires apply a compressive load to said derrick launcher and that compressive load is not applied to the derrick sections supported thereby.

10. The method of claim 9 wherein said guy wires are connected at the upper end of said derrick launcher and the derrick sections are moveable axially within said derrick launcher.

11. The method of claim 1 including the step of raising a derrick section in said derrick launcher by extending a flexible cable vertically in said derrick launcher to engage the derrick section therein, and hoisting the derrick section supported on the cable for upward movement to a registered location enabling a subsequent derrick section to be inserted into said derrick launcher therebelow.

12. The method of claim 11 wherein said derrick launcher incorporates an open upper end enabling the derrick to be assembled of a number of derrick sections serially added at said derrick launcher wherein each of the derrick sections is aligned below the previously installed derrick section.

13. The method of claim 12 wherein said derrick launcher incorporates a side loading door of sufficient height to receive a derrick section in an upstanding position, and further wherein a derrick section is moved from a remote location into an upright position and is then moved to an upright position into said derrick launcher.

14. The method of claim 1 wherein the step of adding the second and subsequent derrick sections into the derrick includes the steps of aligning the last added derrick section with the previously derrick section and making an interconnection therebetween by joining cooperative means connecting adjacent derrick sections together.

15. The method of claim 1 wherein the crown assembly is added at the top of the first derrick section.

16. The method of claim 15 wherein the derrick launcher incorporates an elevated catwalk, and personnel are permitted to stand thereon, and including the step of attaching at the top end of the first derrick section the crown assembly by hoisting the crown assembly and completing attaching to the first derrick section above the catwalk.

17. The method of claim 16 wherein the crown assembly is adjusted to position the load line laterally and parallel to the derrick.

18. The method of claim 16 wherein the crown assembly is rotated relative to the derrick to position the load line.

19. The method of claim 16 wherein first and second load lines are extended up the derrick to the crown assembly and down the derrick to the well.

* * * * *